US006692819B1

(12) United States Patent
Castle et al.

(10) Patent No.: US 6,692,819 B1
(45) **Date of Patent: *Feb. 17, 2004**

(54) METHOD OF TRANSPARENTIZING A CELLULOSE SUBSTRATE

(75) Inventors: William J. Castle, Hilliard, OH (US); Rajendra Mehta, Centerville, OH (US)

(73) Assignee: The Standard Register Company, Dayton, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 217 days.

This patent is subject to a terminal disclaimer.

(21) Appl. No.: 09/477,685

(22) Filed: Jan. 6, 2000

Related U.S. Application Data

(60) Provisional application No. 60/115,082, filed on Jan. 7, 1999.

(51) Int. Cl.[7] ..... B32B 3/00; B05D 3/02; B65D 27/04

(52) U.S. Cl. ..... 428/211.1; 428/500; 427/487; 427/508; 427/374.2; 427/398.1; 229/71

(58) Field of Search ..... 428/195, 211, 428/500; 427/487, 508, 374.2, 398.1; 229/71

(56) References Cited

U.S. PATENT DOCUMENTS

| | | | | |
|---|---|---|---|---|
| 3,813,261 A | | 5/1974 | Muller | |
| 4,137,046 A | | 1/1979 | Koike et al. | |
| 4,198,465 A | | 4/1980 | Moore et al. | |
| 4,237,185 A | * | 12/1980 | Lombardi et al. | 428/337 |
| 4,416,950 A | | 11/1983 | Muller et al. | |
| 4,513,056 A | | 4/1985 | Vernois et al. | |
| 5,076,489 A | | 12/1991 | Steidinger | |
| 5,418,205 A | * | 5/1995 | Mehta et al. | 503/206 |
| 5,983,993 A | | 11/1999 | Watson et al. | |

* cited by examiner

*Primary Examiner*—Cynthia H. Kelly
(74) *Attorney, Agent, or Firm*—Dinsmore & Shohl LLP

(57) ABSTRACT

A method of transparentizing a cellulosic substrate which is suitable for use as a mailer or envelope having at least one transparentized portion is provided. The method includes the application of a transparentizing composition to a substrate by a flexographic printing apparatus in which one or more of the transparentizing composition, the substrate, and the transfer rollers of the printing apparatus are preferably cooled prior to application in order to raise the viscosity of the composition and allow more of the composition to be transferred to the substrate surface. A primer composition may also be applied to the substrate prior to application of the transparentizing composition in order to aid in penetration of the transparentizing composition.

27 Claims, 2 Drawing Sheets

METHOD OF TRANSPARENTIZING A CELLULOSE SUBSTRATE

CROSS REFERENCE TO RELATED APPLICATIONS

This application claims the benefit of U.S. provisional application Serial No. 60/115,082 filed Jan. 7, 1999.

BACKGROUND OF THE INVENTION

The present invention relates to a method of transparentizing a cellulosic substrate suitable for use as an envelope or mailer, and more particularly, to a method of transparentizing a portion of a substrate utilizing a transparentizing composition.

A number of approaches to providing a transparent portion in an envelope or the like are known. Various types of envelopes or mailers with transparent windows exist where the window consists of a cut-out opening in the mailer substrate which is covered by a transparent patch. The transparent patch is usually secured over the cut-out opening by means of an adhesive, and may consist of any suitable film of transparent material such as glassine, cellophane, or polymeric materials including polyester, polyethylene, polycarbonate, polystyrene, and polyethylene terephthalate. However, such transparent patch configurations have numerous disadvantages. For example, added thickness caused by such window patches over die-cut window openings can cause feeding problems in printers and uneven stacks.

An alternative to the use of a cut-out opening/transparent patch is to apply a transparentizing material to a predetermined portion of the cellulosic mailer substrate to form a substantially transparent window. Such a method entails the impregnation of the cellulosic mailer substrate with a transparentizing material such that the spaces between the fibers of the substrate are filled by the transparentizing material. In order to make the impregnated portion transparent, the transparentizing material must have a refractive index close to that of cellulose (1.5). Examples of known transparentizing methods and materials are disclosed in U.S. Pat. No. 3,813,261 to Muller, U.S. Pat. No. 4,137,046 to Koike et al., U.S. Pat. No. 4,198,465 to Moore et al., and U.S. Pat. No. 5,418,205 to Mehta.

In order to produce high quality cellulosic mailers on a large, industrial scale by employing a transparentizing material, it is desirable that the transparentizing material be capable of achieving at least three important functions: 1) the ability to produce a transparentized portion which possesses a number of physical and chemical properties; 2) the ability to be converted quickly from a penetrating liquid to a solid after impregnation has occurred; and 3) the ability to quickly penetrate the cellulosic mailer substrate in order to fully impregnate the substrate in the shortest time possible. The drawback to producing mailers in this manner, however, is that most transparentizing materials can perform, at most, only one of the aforementioned functions.

Physically, the transparentized portion of a cellulosic mailer substrate should be strong and flexible (i.e., not brittle) and be receptive to inks. Chemically, the transparentized portion should meet U.S. Postal Service specifications for reflectance (sufficient transparency to read the printing beneath the transparentized portion) and PCR ("Print Contrast Ratio"-sufficient contrast between the printing and background beneath the transparentized portion) and should have sufficient resistance to migration and/or volatilization of the transparentizing material from the place where applied on the mailer substrate such that it does not lose its transparency over time.

While some transparentizing materials may be capable of providing fast penetration rates, they are not capable of producing transparentized portions which possess the desired physical and chemical properties. U.S. Pat. No. 5,076,489 to Steidinger, for example, discloses using either wax or oil as the transparentizing material. Wax produces a brittle transparentized area which is easily marred by physical contact therewith to cause a loss of transparency. In addition, wax is not receptive to inks and therefore cannot be printed upon. Oil tends to migrate and/or volatilize easily, thus resulting in a loss of transparency over time.

In an attempt to overcome these problems, liquid polymerizable transparentizing compositions have been utilized in which the paper substrate is first rendered transparent by impregnating it with the liquid polymerizable transparentizing composition and the transparentizing composition is then cured in situ to solidify the transparentized portion. These polymerizable transparentizing compositions offer several advantages over conventional transparentizing materials in that the end-product is usually strong and flexible and does not lose its transparency over time due to migration or/or volatilization. However, there are problems associated with the use of these polymerizable transparentizing compositions. For example, the rate at which some of the liquid polymerizable transparentizing compositions penetrate a cellulosic substrate is so slow that, after applying the transparentizing composition to the substrate, the substrate must be wound up in a tight roll for a period of time to allow the material to impregnate the substrate. See for example, U.S. Pat. No. 4,416,950 to Muller et al. It is known to include a solvent with the polymerizable transparentizing composition to lower the viscosity thereof and thereby speed the rate of penetration of the transparentizing composition into the cellulosic mailer substrate (see, e.g., U.S. Pat. No. 4,513,056 to Vernois et al). However, the use of solvents with transparentizing materials is undesirable due to the added process machinery required to evaporate the solvent from the substrate surface and to recover the evaporated solvent. While it is known to include water or water-alcohol mixtures with the transparentizing material to increase wetting and thus increase the rate of penetration into the substrate (see U.S. Pat. No. 3,813,261 to Muller et al.), the use of water is typically not considered conducive to high-speed production due to the time associated with removing the water from the cellulosic substrate.

Accordingly, there is still a need in the art for a method of transparentizing a portion of a substrate suitable for use as a mailer or envelope which provides complete penetration at high production speeds used to produce envelopes or mailers.

SUMMARY OF THE INVENTION

Those needs are met by the present invention which provides a method for transparentizing a cellulosic substrate in which the transparentizing composition is applied at a temperature of less than about 70° F. (21° C.) to achieve high loading on the substrate. After subsequent heating, the transparentizing composition penetrates the mailer substrate very quickly and completely, and forms a cured polymeric transparentized portion which possesses the aforementioned physical and chemical properties. In this manner, a very high-quality transparentized portion can be formed on cellulosic mailer substrates in a fast, continuous, in-line process.

According to one aspect of the present invention, a method of transparentizing a cellulosic substrate is provided which includes a) providing a cellulosic substrate having first and second surfaces, b) applying a polymerizable transparentizing composition to at least one portion of the first or second surfaces of the substrate, and c) curing the composition. The transparentizing composition is applied at a temperature of less than about 70° F. (21° C.). Preferably, prior to application, the transparentizing composition is cooled and its viscosity is temporarily raised to allow more of the composition to be transferred to the substrate (i.e., to increase loading).

The transparentizing composition is preferably applied to the substrate by a flexographic printing apparatus which includes a fountain roller, an anilox roller, a plate cylinder and an impression cylinder, where at least one of the fountain roller, anilox roller, plate cylinder, or impression cylinder is preferably cooled. In another preferred embodiment, the substrate is preferably cooled prior to application of the transparentizing composition.

The transparentizing composition is preferably applied on a corresponding portion of both the first and second surfaces of the substrate. The transparentizing composition preferably comprises an acrylated epoxy oligomer and a blend of acrylate monomers. More preferably, the composition comprises from about 45 to 55% by weight of the acrylated epoxy oligomer, from about 35 to 40% of the blend of acrylate monomers. Where the transparentizing composition is cured by ultraviolet radiation, the composition preferably further includes from about 5 to 10% of a photoinitiator, or blends thereof. Preferably, the transparentizing composition has a viscosity of from about 100 to 2500 cps at room temperature (i.e., 70° F. (21° C.)), and more preferably, about 600 cps. When the transparentizing composition is applied to the substrate, it preferably has a viscosity of about 1200 cps.

In a preferred embodiment of the invention, a primer composition is applied to a portion of the substrate prior to application of the transparentizing composition. The primer functions as a wetting agent which aids in penetration of the transparentizing composition into the substrate. The primer composition preferably comprises a hydrocarbon resin, vegetable oil, a high molecular weight alcohol, and an aliphatic hydrocarbon solvent. In a preferred embodiment, the primer composition comprises from about 35 to 45% by weight of a hydrocarbon resin, from about 20 to 25% by weight vegetable oil, from about 25 to 35% by weight aliphatic hydrocarbon solvent, and from about 5 to 8% by weight high molecular weight alcohol. The primer composition is preferably applied to a corresponding portion of both the first and second surfaces of the substrate prior to application of the transparentizing composition.

After application of the transparentizing composition and the optional primer to the substrate, the substrate is preferably heated to warm the transparentizing composition. This causes the viscosity of the transparentizing composition to drop rapidly and speeds up the penetration of the composition into the substrate.

The transparentizing composition is then preferably cured by radiation such as electron beam or ultraviolet radiation, preferably ultraviolet radiation. The curing step causes the components in the transparentizing composition to polymerize, resulting in a permanently transparentized portion which will not migrate or volatilize. In a preferred embodiment of the invention, the substrate is cooled after the curing step to lower the temperature of the substrate back to room temperature. In an alternative embodiment, the substrate may be cooled after the heating step described above (prior to curing).

After the curing step, indicia may then be printed on the transparentized portion of the substrate. The resulting cellulosic substrate has at least one transparentized portion and may be used as an envelope or mailer. Preferably, the transparentized portion has a smooth interface between itself and the remainder of the substrate, and the transparentized portion has a thickness which is no greater than the thickness of the remainder of the substrate. By "smooth interface", it is meant that no loose or sharp edges are present which could get caught in process equipment and cause jams or tears. By "transparentized", it is meant that there is sufficient transparency to read printing beneath the transparentized portion of the substrate (reflectance of at least 50% in the red spectrum and at least 45% in the green spectrum), and sufficient contrast between the printing and background portion beneath the transparentized portion to provide a print contrast ratio of at least 30%. The transparentized portion of the substrate preferably exhibits an opacity of from about 40 to 65.

Accordingly, it is a feature of the present invention to provide a method of transparentizing a cellulosic substrate suitable for use as a mailer or envelope which allows high loading of the transparentizing composition onto a substrate and forms a cured polymeric transparentized portion.

DETAILED DESCRIPTION OF THE INVENTION

The method of the present invention provides an advantage over previous transparentizing methods in that the transparentizing composition is preferably cooled prior to application so that more of the composition can be loaded onto the cellulosic substrate. In prior methods, a low viscosity transparentizing material has been used in an attempt to achieve high loading; however, we have found that using a composition which is higher in initial viscosity will result in transferring a greater amount of the transparentizing material to the surface of the substrate. With the method of the present invention, the transparentizing composition may be applied to the substrate at a coating weight of about 5 to 6 lbs/ream (17×22×500 sheet ream) (2.2 to 2.7 kg/120 $m^2$). The ability to load more transparentizing material onto the paper substrate is highly desirable in that there is a direct relationship between the amount of transparentizing material loaded on the paper and the degree of transparency achieved in the final product.

Figure 1:
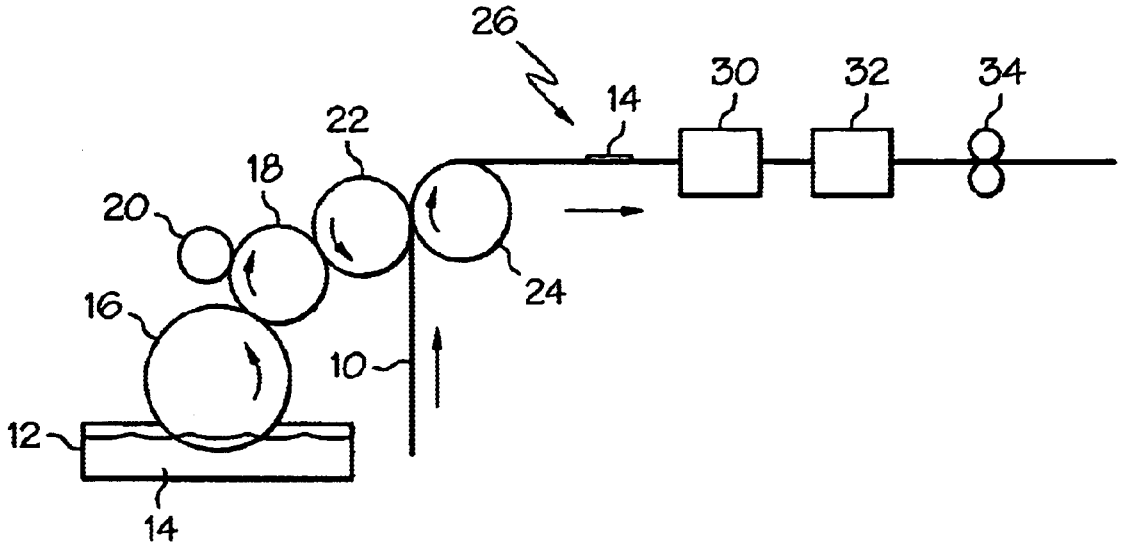
FIG. 1 is a schematic view of the flexographic printing process for applying the transparentizing composition to cellulosic substrate.

Referring now to FIG. 1, the method of transparentizing a substrate is illustrated. A continuous web 10 is provided comprising a substrate. Preferred substrates for use in the present invention include uncoated stocks containing minimal fillers. Suitable uncoated papers include those ranging from 15# bond to 100# tag, depending on the degree of transparency desired. We have found that an improvement in optical clarity can be achieved by using thinner and lower basis weight papers such as 50# offset papers. The use of higher density papers will also improve the optical results.

A reservoir 12 contains a transparentizing composition 14. The transparentizing composition of the present invention preferably comprises 45–55% by weight acrylated epoxy oligomer, 35–40% by weight of a UV monomer blend (a mixture of di- and tri-acrylates), about 0.2 to 0.5% optical brighteners, and from about 5–10% by weight of a photoinitiator blend including a free radical catalyst. Such a composition is commercially available from Continental Ink under the designation Flint #54615. The composition may have a viscosity of 100 cps to 2500 cps at ambient temperature (i.e., 70° F. (21° C.)), and preferably about 600 cps.

Preferably, the transparentizing composition is cooled in the reservoir by circulation of cooling water around the reservoir such that the composition has a viscosity at the time of application of about twice its original viscosity, preferably around 1200 cps. The transparentizing composition 14 is drawn from the reservoir 12 by a fountain roller 16. The composition is then transferred to an anilox roll 18 and metered by a metering roller 20. The composition is then transferred from the anilox roll 18 to a flexographic plate cylinder 22. Each of the rollers 16, 18, 20, and 22 are preferably cooled to maintain the high viscosity of the transparentizing composition by the attachment of chill applicator units (not shown).

The continuous web 10 is advanced such that it makes contact with the plate cylinder 22 and an impression cylinder 24. The printing plates (not shown) on the plate cylinder 22 receive the transparentizing composition from the anilox roll and transfer the composition to the web 10. The plates are preferably comprised of a photopolymer with a course 65 line 50% screen. As shown, a predetermined portion 26 of the web 10 is impregnated with the transparentizing composition of the present invention. Portion 26 can be any predetermined portion of the substrate where it is desired to place a transparentized portion. To provide even faster penetration of the transparentizing composition into the substrate, the composition may be applied simultaneously to both the first and second surfaces of the predetermined portion using flexographic or rotogravure printing techniques. This reduces the penetration distance to one-half the thickness of the substrate.

In order to achieve increased penetration of the transparentizing composition into the substrate, a primer composition may be applied to the web just prior to applying the transparentizing composition. The primer composition may be applied using offset, letterpress or flexographic equipment. The primer composition preferably comprises about 35–45% by weight hydrocarbon resin, 25–25% by weight vegetable oil, such as soybean oil or linseed oil, 5–8% of a high molecular weight alcohol, 0.2 to 0.5% optical brighteners, and 25–35% by weight aliphatic hydrocarbon solvent. Such a primer composition is commercially available from Continental Ink under the designation Flint #54469. The primer may be applied to both the front and back of the web simultaneously using conventional print towers. We have found that the inclusion of a high molecular weight alcohol in the primer acts as a wetting agent, increasing the speed of penetration of transparentizing composition into the paper substrate and allowing for faster line-speeds.

After the transparentizing composition and optional primer composition are applied to the web 10, the web is passed through a heated device 30 such as an oven or dryer which warms up the coating and temporarily drops the viscosity of the composition to speed the penetration of the composition through the substrate. Passing the web through the heating device 30 also allows time for the composition to further penetrate the substrate prior to the curing step. Preferred for use in the present invention is a radiant heated dryer sufficient to maintain a web temperature of about 225° F.

When the web 10 exits from the oven 30, it preferably passes through a curing station 32 to cure the transparentizing composition. The composition is preferably cured by UV radiation using UV dryers with wattage sufficient to fully cure the composition. The preferred wavelength of the ultraviolet curing light is from about 200 to about 400 nanometers, and the preferred ultraviolet curing light capacity is from about 200 to about 600 watts per inch of substrate width (500 to about 1500 watts per centimeter). It should be appreciated that the transparentizing composition may also be cured by other forms of radiation such as electron beam radiation. If the transparentizing composition is cured by electron beam radiation, it is not necessary to include a photocatalyst in the composition.

After the curing step, the web 10 is preferably passed through chill rolls 34 which stabilize the web and lower the temperature of the web to room temperature. Alternatively, the web may be passed through chill rolls prior to curing.

In the preferred method of the present invention which utilizes a flexographic printing press in combination with ultraviolet curing, a typical rate of transparentization (i.e., applying the primer and/or transparentizing composition and curing it) is from about 150 to 600 linear feet (about 22.9 meters to about 91.6 meters) of substrate per minute.

It is preferred that the transparentizing composition, once cured, have a refractive index as close as possible to that of the substrate to ensure that the transparentized portion will be sufficiently transparent. Most cellulosic substrates have a refractive index of around 1.5. Thus, the preferred refractive index of the cured coating is similarly around 1.5.

The resulting transparentized portion also meets all of the desired physical and chemical properties; i.e., it is strong, flexible and durable such that it will maintain its transparency when subjected to rough handling, and is highly receptive to inks and/or toners. Chemically, the transparentized portion 40 has sufficient resistance to ultraviolet radiation that it does not lose its transparency over time. The transparentized portion meets U.S. Postal Service specifications for reflectance and PCR. Additionally, transparentized portion 40 has sufficient resistance to migration and/or volatilization of the radiation cured transparentizing material that it does not lose its transparency over time.

Figure 2:
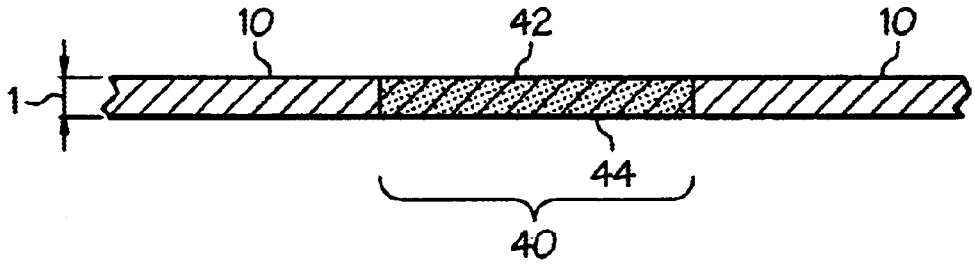
FIG. 2 is a cross-sectional view of the cellulosic substrate after the predetermined portion has been coated with the transparentizing composition.

FIG. 2 illustrates a cross-section of the substrate 10 after the transparentizing composition has been applied and cured. As can be seen, a transparentized portion 40 is provided on the substrate which may be provided with printed information, for example, addresse information may be printed on the first or second surfaces 42, 44 of the substrate. In the embodiment shown, the transparentized portion 40 forms a smooth interface with the remainder of the substrate 10. However, it should be appreciated that the transparentized portion may be also be made thinner than the remainder of the substrate by removing a section of the thickness therefrom or by compressing it. Thinning of the transparentized area may be accomplished by the methods described in U.S. Pat. No. 5,418,205, the disclosure of which is incorporated herein by reference.

Figure 3:
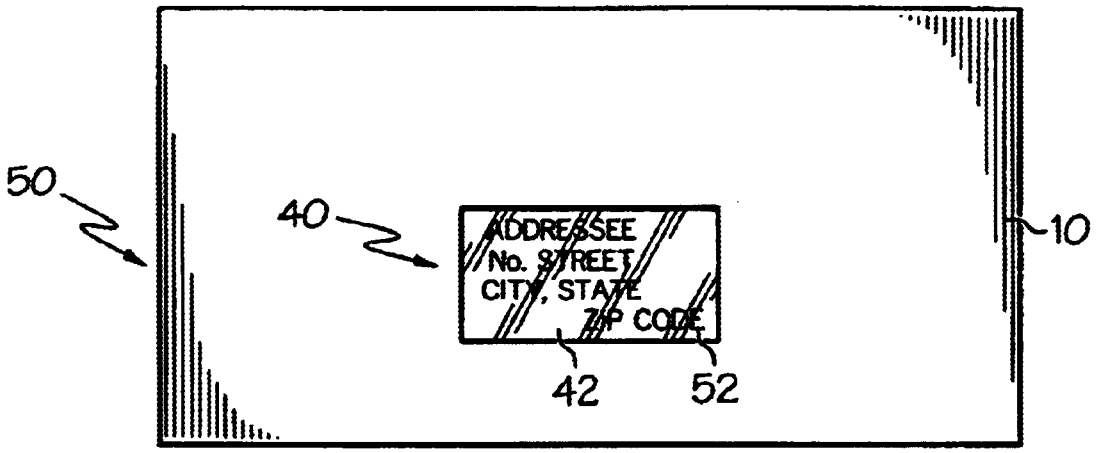
FIG. 3 is a front-elevational view of a mailer having a transparentized portion showing addressee information.
Figure 4:
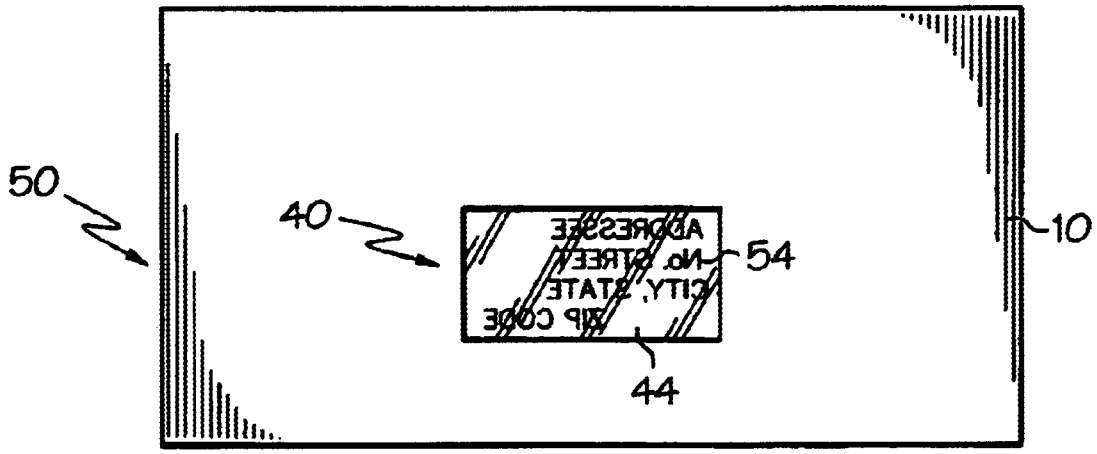
FIG. 4 is a rear view of a mailer having a transparentized portion which has been printed with a reverse image.

FIGS. 3 and 4 illustrate a mailer or envelope 50 formed from the cellulosic substrate or web 10 of the present invention. Substrate 10 includes a transparentized portion 40 which allows the addressee information 52 on the inside of the mailer to be viewed from the outside of the mailer. Addressee information may be provided by printing on a separate insert; printing the rear inside surface of the mailer substrate, or by printing the second surface 44 of the transparentized portion of the substrate (see FIG. 4). Mailer 50 can be any type of mailer or envelope, such as an inter-office mailer or one which is mailed through the U.S. Postal Service.

FIG. 4 illustrates a mailer 50 which has been printed on the transparentized portion 40 with a reverse image 54. Reverse image 54 can be printed with any conventional printing means, such as laser printing, ion deposition printing, ink jet printing, or thermal transfer techniques. By printing the image in reverse, when viewed from the outside of the mailer, the image will appear as a normal image to the user.

In order that the invention may be more readily understood, reference is made to the following examples, which are intended to be illustrative of the invention but are not intended to be limiting in scope.

EXAMPLE 1

A radiation curable transparentizing composition (Flint #54615, available from Continental Ink) was applied to a 50# offset substrate by flexographic printing and cured by ultraviolet radiation at a wavelength of from about 200 to about 400 nanometers. The printed substrate was then imaged in a laser printer (reverse imaged) and subsequently tested to determine whether the transparentized material may be read using U.S. Postal Service automation requirements. The test results indicated that the samples tested above a print reflectance difference of at least 30% per DMM C840.5.2 (Domestic Mail Manual published by the U.S. Postal Service).

EXAMPLE 2

A primer composition (Flint #54469, available from Continental Ink) was applied to a 60# offset substrate by flexographic printing. A transparentizing composition (Flint #54615) was then applied to the substrate by flexographic printing and cured as described in Example 1. The printed substrate was then imaged in a laser printer (reverse imaged) and subsequently tested to determine whether the transparentized material may be read using U.S. Postal Service automation requirements. The test results indicate that the samples tested above a print reflectance difference of at least 30% per DMM C840.5.2.

While representative embodiments and certain details have been shown for purposes of illustrating the invention, it will be apparent to those skilled in the art that various changes in the methods and apparatus disclosed herein may be made without departing from the scope of the invention, which is defined in the appended claims.

What is claimed is:

1. A method of transparentizing a cellulosic substrate which comprises:

a) providing a cellulosic substrate having first and second surfaces;

b) providing a polymerizable transparentizing composition;

c) cooling said transparentizing composition to increase the viscosity of said transparentizing composition;

d) applying said cooled transparentizing composition to at least one portion of said first or second surfaces of said substrate at a viscosity which is greater than the viscosity of said transparentizing composition before cooling; and e) curing said composition.

2. The method of claim 1 wherein said transparentizing composition is applied to said substrate by a flexographic printing apparatus which includes a fountain roller, an anilox roller, a plate cylinder and an impression cylinder, wherein at least one of said fountain roller, anilox roller, plate cylinder, or impression cylinder is cooled.

3. The method of claim 1 in which said transparentizing composition has a viscosity of from about 100 to 2500 cps at room temperature.

4. The method of claim 1 in which said transparentizing composition is applied at a viscosity which is about two times greater than the viscosity of said transparentizing composition before cooling.

5. The method of claim 1 including cooling said substrate prior to application of said transparentizing composition.

6. The method of claim 1 including heating said substrate after the application of said transparentizing composition to said substrate.

7. The method of claim 6 including cooling said substrate after said heating step.

8. The method of claim 6 including cooling said substrate after said curing step.

9. The method of claim 1 wherein said transparentizing composition is applied on a corresponding portion of both said first and second surfaces of said substrate.

10. The method of claim 1 wherein said transparentizing composition comprises an acrylated epoxy oligomer and a blend of acrylate monomers.

11. The method of claim 1 wherein said transparentizing composition comprises from about 45 to 55% by weight of an acrylated epoxy oligomer and from about 35 to 40% of a blend of acrylate monomers.

12. The method of claim 11 wherein said transparentizing composition further comprises from about 5 to 10% of a photoinitiator.

13. A method of transparentizing a cellulosic substrate which comprises:

a) providing a cellulosic substrate having first and second surfaces:

b) applying a primer composition to at least one portion of said first or second surface of said substrate;

c) applying a polymerizable transparentizing composition to said at least one portion of said substrate at a temperature of less than about 70° F.; and d) curing said composition.

14. The method of claim 13 wherein said primer composition comprises a hydrocarbon resin, vegetable oil, a high molecular weight alcohol, and an aliphatic hydrocarbon solvent.

15. The method of claim 13 wherein said primer composition comprises from about 35 to 45% by weight of a hydrocarbon resin, from about 20 to 25% by weight vegetable oil, from about 25 to 35% by weight aliphatic hydrocarbon solvent, and from about 5 to 8% by weight high molecular weight alcohol.

16. The method of claim 1 including applying a primer composition to a corresponding portion of both said first and second surfaces of said substrate prior to application of said transparentizing composition.

17. The method of claim 1 wherein said transparentizing composition is cured by ultraviolet radiation.

18. The method of claim 1 including printing indicia on the transparentized portion of said substrate after said curing step.

19. The method of claim 1 wherein said transparentizing composition is applied to less than the entire first or second surface of said substrate.

20. A cellulosic substrate suitable for use as an envelope or mailer having at least one transparentized portion formed by the method of claim 1.

21. The substrate of claim 20 wherein said transparentizing composition has been applied to both of said first and second surfaces of said substrate.

22. The substrate of claim 20 wherein said transparentized portion exhibits an opacity of from about 40 to 65.

23. A mailer having a transparentized portion formed by the method of claim 1.

24. A method of transparentizing a cellulosic substrate which comprises:

a) providing a cellulosic substrate having first and second surfaces;

b) applying a polymerizable transparentizing composition to at least one portion of said first or second surfaces of said substrate, said transparentizing composition having a viscosity of about 1200 cps upon application to said substrate; and c) curing said composition.

25. A method of transparentizing a cellulosic substrate which comprises:

a) providing a cellulosic substrate having first and second surfaces;

b) applying a polymerizable transparentizing composition to said substrates by a flexographic printing apparatus which includes a fountain roller, an anilox roller, a plate cylinder, and an impression cylinder, wherein at least one of said fountain roller, anilox roller, plate cylinder, or impression cylinder is cooled to increase the viscosity of said transparentizing composition; and c) curing said composition.

26. A method of transparentizing a cellulosic substrate which comprises:

a) providing a cellulosic substrate having first and second surfaces;

b) cooling said substrate;

c) applying a polymerizable transparentizing composition to at least one portion of said first or second surface of said cooled substrate such that the viscosity of said transparentizing composition is increased; and d) curing said composition.

27. A method of transparentizing a cellulosic substrate which comprises:

a) providing a cellulosic substrate having first and second surfaces;

b) providing a polymerizable transparentizing composition;

c) cooling said transparentizing composition to increase the viscosity of said transparentizing composition;

d) applying said cooled transparentizing composition to at least one portion of said first or second surfaces of said substrate;

e) heating said substrate to reduce the viscosity of said transparentizing composition; and f) curing said composition.

* * * * *